US011695194B2

(12) United States Patent
Tokuda et al.

(10) Patent No.: US 11,695,194 B2
(45) Date of Patent: Jul. 4, 2023

(54) REAR GLASS

(71) Applicant: Nippon Sheet Glass Company, Limited, Tokyo (JP)

(72) Inventors: Tatsumi Tokuda, Tokyo (JP); Ryokichi Doi, Tokyo (JP)

(73) Assignee: NIPPON SHEET GLASS COMPANY, LIMITED, Tokyo (JP)

( * ) Notice: Subject to any disclaimer, the term of this patent is extended or adjusted under 35 U.S.C. 154(b) by 0 days.

(21) Appl. No.: 16/980,099

(22) PCT Filed: Mar. 14, 2019

(86) PCT No.: PCT/JP2019/010546
§ 371 (c)(1),
(2) Date: Sep. 11, 2020

(87) PCT Pub. No.: WO2019/177098
PCT Pub. Date: Sep. 19, 2019

(65) Prior Publication Data

US 2021/0249754 A1 Aug. 12, 2021

(30) Foreign Application Priority Data

Mar. 16, 2018 (JP) ..... 2018-050275

(51) Int. Cl.
*H01Q 1/12* (2006.01)
*H01Q 21/30* (2006.01)
*H05B 3/84* (2006.01)

(52) U.S. Cl.
CPC ..... *H01Q 1/1278* (2013.01); *H01Q 21/30* (2013.01); *H01Q 1/1285* (2013.01); *H05B 3/84* (2013.01)

(58) Field of Classification Search
CPC ... H01Q 1/1271; H01Q 1/1278; H01Q 1/1285
See application file for complete search history.

(56) References Cited

U.S. PATENT DOCUMENTS 5,101,212 A * 3/1992 Shinnai ..... H01Q 1/1271 343/704
5,231,410 A * 7/1993 Murakami ..... H01Q 1/1278 343/704

(Continued)

FOREIGN PATENT DOCUMENTS

EP 2485325 A1 8/2012
JP 61-265903 A 11/1986

(Continued)

OTHER PUBLICATIONS

International Search Report, issued in PCT/JP2019/010546, PCT/ISA/210, dated May 21, 2019.

(Continued)

*Primary Examiner* — Ab Salam Alkassim, Jr.
(74) *Attorney, Agent, or Firm* — Birch, Stewart, Kolasch & Birch, LLP

(57) ABSTRACT

A rear glass according to the invention is for attachment to a lift-up backdoor that closes an opening in a rear portion of a vehicle, and includes a glass plate, a defogger disposed in a vicinity of a center of the glass plate in an up-down direction, and a shared antenna installed on the glass plate upward or downward of the defogger, the shared antenna including a power supply unit, an AM antenna connected to the power supply unit, and an FM antenna connected to the power supply unit, and a relationship between an element length $L_{AM}$ of the AM antenna, a center wavelength $\lambda_{FM\text{-}C}$ corresponding to a reception frequency band of the FM antenna and a wavelength shortening coefficient $\alpha$ of the glass plate satisfying $0.49\times\alpha\times\lambda_{FM\text{-}C}\leq L_{AM}\leq 0.67\times\alpha\times\lambda_{FM\text{-}C}$.

12 Claims, 16 Drawing Sheets

(56) References Cited

U.S. PATENT DOCUMENTS 5,334,988 A * 8/1994 Murakami ..... H01Q 1/1278 343/704
5,610,619 A * 3/1997 Zafar ..... H01Q 1/1271 343/704
5,821,904 A * 10/1998 Kakizawa ..... H01Q 1/1278 343/704
6,064,345 A * 5/2000 Ohnishi ..... H01Q 1/1278 343/704
6,163,303 A * 12/2000 Nagy ..... H01Q 1/1278 343/860
6,201,506 B1 * 3/2001 Endo ..... H01Q 1/1278 343/704
6,215,450 B1 * 4/2001 Oka ..... H01Q 1/1271 343/704
7,019,700 B2 3/2006 Fuji et al.
7,227,503 B2 * 6/2007 Baba ..... H01Q 1/1278 343/711
2005/0030235 A1 * 2/2005 Noguchi ..... H01Q 1/1278 343/704
2006/0012532 A1 * 1/2006 Baba ..... H01Q 1/1278 343/713
2008/0158073 A1 * 7/2008 Ibe ..... H01Q 1/1271 343/713
2008/0169990 A1 * 7/2008 Taniguchi ..... H01Q 5/364 343/713
2010/0328170 A1 * 12/2010 Kuehne ..... H01Q 1/1278 343/712
2011/0032163 A1 * 2/2011 Noguchi ..... H01Q 1/32 343/711
2011/0037668 A1 * 2/2011 Mukai ..... H01Q 9/16 343/712
2011/0115681 A1 * 5/2011 Oshima ..... H01Q 5/40 343/713
2012/0249382 A1 * 10/2012 Tadokoro ..... H01Q 1/1271 343/713
2013/0162488 A1 6/2013 Onaka et al.
2013/0257663 A1 * 10/2013 Saito ..... H01Q 5/371 343/712
2016/0268670 A1 * 9/2016 Kobayashi ..... H01Q 1/1278
2016/0359219 A1 * 12/2016 Araki ..... H01Q 1/1278
2016/0372815 A1 * 12/2016 Hayashi ..... H01Q 1/1278
2017/0125877 A1 * 5/2017 Ochi ..... H01Q 9/42
2017/0279182 A1 * 9/2017 Hayashi ..... H01Q 1/52
2018/0069290 A1 * 3/2018 Yamamoto ..... H05B 3/84
2018/0123219 A1 * 5/2018 Doi ..... H01Q 1/02
2018/0233803 A1 * 8/2018 Nakano ..... H01Q 1/1278
2018/0233818 A1 * 8/2018 Nakano ..... H01Q 5/40
2018/0277924 A1 * 9/2018 Shigeta ..... H01Q 9/42
2019/0190117 A1 * 6/2019 Morishita ..... H01Q 5/392
2020/0411947 A1 * 12/2020 Saito ..... B60J 5/10

FOREIGN PATENT DOCUMENTS

JP 2008-172627 A 7/2008
JP 2010-93781 A 4/2010
JP 2011-135405 A 7/2011
JP 2014-138193 A 7/2014
JP 2016-213580 A 12/2016
WO WO 2012/029390 A1 3/2012
WO WO 2012/073796 A1 6/2012
WO WO 2017/208569 A1 12/2017

OTHER PUBLICATIONS

Written Opinion of the International Searching Authority, issued in PCT/JP2019/010546, PCT/ISA/210, dated May 21, 2019.
Extended European Search Report for European Application No. 19767780.0, dated Nov. 5, 2021.
Japanese Office Action for Japanese Application No. 2020-506647, dated Jul. 12, 2022, with English translation.

* cited by examiner

REAR GLASS

TECHNICAL FIELD

This invention relates to a rear glass that is attached to a backdoor of a rear portion of a vehicle.

BACKGROUND ART

While a plurality of antennas for various media such as AM, FM, DTV and DAB are provided on the rear glass of automobiles, shared antennas having a common power supply unit have increasingly been used in recent years for the purpose of reducing the number of components such as connection terminals and cables. AM and FM, in particular, have increasingly been installed as a shared antenna (e.g., Patent Literature 1).

CITATION LIST

Patent Literature

Patent Literature 1: JP 2011-135405A

SUMMARY OF INVENTION

Technical Problem

Incidentally, there is a problem in that reception sensitivity deteriorates when an AM antenna is disposed in a position near a metallic region such as the body flange on the periphery of the rear glass or the defogger in the center of the rear glass. Thus, an AM/FM shared antenna such as the above is disposed a fixed distance away from metallic regions, mainly in consideration of the AM reception characteristics. However, when such AM constraints are taken into consideration, sufficient reception performance cannot be obtained with regard to FM of the AM/FM shared antenna. The invention has been made in order to solve this problem, and an object thereof is to provide a rear glass that can obtain favorable reception sensitivity with regard to both AM and FM in an AM/FM shared antenna.

Solution to Problem

A first invention is a rear glass for attachment to a lift-up backdoor that closes an opening in a rear portion of a vehicle, the rear glass including a glass plate, a defogger disposed in a vicinity of a center of the glass plate in an up-down direction, and a shared antenna installed on the glass plate upward or downward of the defogger, the shared antenna including a power supply unit, an AM antenna connected to the power supply unit, and an FM antenna connected to the power supply unit, and a relationship between an element length LA of the AM antenna, a center wavelength $\lambda_{FM\text{-}C}$ corresponding to a reception frequency band of the FM antenna and a wavelength shortening coefficient $\alpha$ of the glass plate satisfying $0.49\times\alpha\times\lambda_{FM\text{-}C}\leq L_{AM}\leq 0.67\times\alpha\times\lambda_{FM\text{-}C}$.

In the above rear glass, the AM antenna can include a first AM antenna element extending in a horizontal direction from the power supply unit, a second AM antenna element extending in the up-down direction from an end portion of the first AM antenna element, and a third AM antenna element extending in the horizontal direction on the power supply unit side from a vicinity of an end portion of the second AM antenna element.

In the above rear glass, the AM antenna can include a fourth AM antenna element extending in the up-down direction on the first AM element side from an end portion of the third antenna AM element, and a fifth AM antenna element extending in the horizontal direction from an end portion of the fourth AM antenna element so as to couple with the second AM antenna element.

In the above rear glass, the defogger can include a pair of bus bars respectively extending in the up-down direction along right and left end portions of the glass plate, and a plurality of heating wires extending horizontally so as to join the pair of bus bars, the FM antenna can include a first FM antenna element extending in the up-down direction toward the defogger from the power supply unit, and a second FM antenna element coupled to an end portion of the first FM antenna element and extending in the horizontal direction, and the second FM antenna element can be capacitively coupled to the heating wire most closely approaching the FM antenna, among the heating wires of the defogger.

In the above rear glass, a distance between the second FM antenna element and the defogger can be set to less than or equal to a distance between the AM antenna and the defogger.

In the above rear glass, a distance in the up-down direction of a space between the defogger and an upper edge or a lower edge of an inner periphery of the backdoor to which the rear glass is attached can be set to less than or equal to 100 mm, the shared antenna can be disposed in the space, and the length of the AM antenna in the up-down direction can be set to less than or equal to 75 mm.

In the above rear glass, the shared antenna can be disposed upward of the defogger.

The above rear glass can further include a DAB antenna.

A second invention is a rear glass for attachment to a backdoor of a rear portion of a vehicle, the rear glass including a glass plate, a defogger disposed in a vicinity of a center of the glass plate in an up-down direction, and a shared antenna installed on the glass plate upward or downward of the defogger, the shared antenna including a power supply unit, an FM antenna connected to the power supply unit, an AM antenna, and a coil disposed between the power supply unit and the AM antenna.

Advantageous Effects of Invention

With a rear glass according to this invention, favorable reception sensitivity can be obtained with regard to both AM and FM in an AM/FM shared antenna.

DESCRIPTION OF EMBODIMENTS

Figure 2:
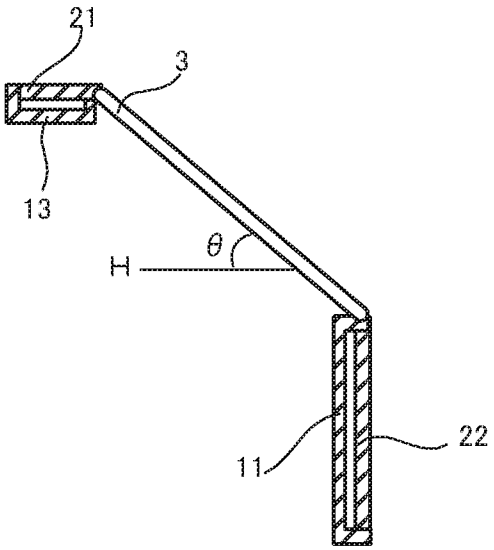
FIG. 2 is a cross-sectional view taken along line A-A in FIG. 1.
Figure 1:
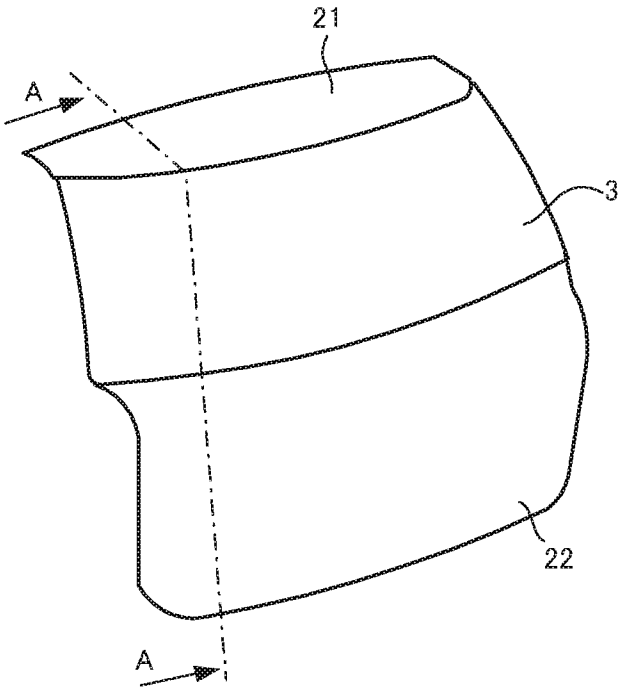
FIG. 1 is a perspective view of a backdoor according to this invention.
Figure 3:
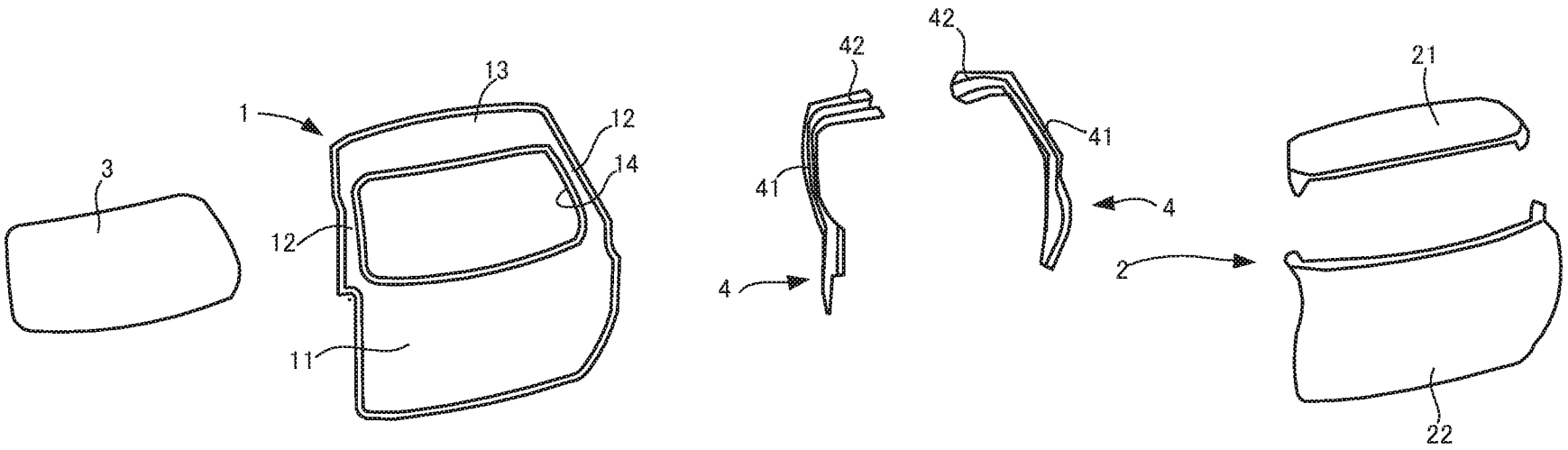
FIG. 3 is an exploded perspective view of the backdoor in FIG. 1.

Hereinafter, an embodiment of a backdoor to which is attached a rear glass according to this invention will be described with reference to the drawings. FIG. 1 is a front view of a backdoor according to this embodiment, FIG. 2 is a cross-sectional view taken along line A-A in FIG. 1, and FIG. 3 is an exploded perspective view of the backdoor in FIG. 1. Note that, hereinafter, for convenience of description, the up-down direction in FIG. 1 may be referred to as, for example, the up-down direction or the vertical direction, and the left-right direction in FIG. 1 may be referred to as the left-right direction or the horizontal direction, based on the orientation of each diagram. This orientation is, however, not intended to limit the invention.

1. Summary of Backdoor

As shown in FIG. 1, a backdoor according to this embodiment closes an opening (illustration omitted) in a rear portion of a hatchback-type vehicle, for example, and is attached to an end portion of a roof panel (illustration omitted) of the vehicle that constitutes an upper edge of this opening via a hinge (illustration omitted). That is, this backdoor constitutes a lift-up door. Specifically, the backdoor is constituted as follows. Note that, in the following description, when indicating the direction of respective regions of the backdoor, the direction in a state where the opening is closed is indicated, unless specifically stated otherwise.

As shown in FIGS. 1 to 3, this backdoor has an inner panel 1 that is disposed on a vehicle interior side, outer panels 21 and 22 that are attached to a vehicle exterior side of this inner panel, a rear glass 3, and a pair of reinforcing frames 4 that are disposed on an upper portion of the inner panel 1.

As shown in FIG. 3, the inner panel 1 is provided with a rectangular main body part 11, a pair of side edge parts 12 that are attached to an upper end portion of this main body part 11, and an upper edge part 13 that couples the upper ends of both side edge parts 12, with these parts being integrally formed. The main body part 11 is a portion that closes a lower portion of the vehicle opening, and is formed so as to extend generally in the vertical direction when the vehicle opening is closed. The two side edge parts 12 respectively extend diagonally upward from both sides of the upper edge of the main body part 11. That is, the two side edge parts 12 extend in a diagonal direction further toward the front of the vehicle while extending upward. Since the upper edge part 13 couples the upper ends of both side edge parts 12, a rectangular window opening part 14 is formed by the upper edge of the main body part 11, the two side edge parts 12, and the upper edge part 13. The rear glass 3 is attached so as to close this window opening part 14.

The outer panels are constituted by two members, that is, an upper panel 21 and a lower panel 22. The upper panel 21 is a rectangular member that covers the upper edge part 13 of the inner panel 1. Also, the lower panel 22 is a member that covers the main body part 11 of the inner panel 1. Accordingly, the rear glass 3 is attached between the upper panel 21 and the lower panel 22.

Since the two reinforcing frames 4 have a symmetrical shape, only the reinforcing frame 4 on the left side will be described here. This reinforcing frame 4 is an L-shaped member having a first region 41 extending in the up-down direction and a second region 42 coupled to an upper end of this first region 41 and extending horizontally toward the right side, with these regions being integrally formed. This reinforcing frame 4 is disposed between the inner panel 1 and the outer panels 21 and 22. That is, the first region 41 of the reinforcing frame 4 is attached to an area corresponding to the side edge part 12 of the inner panel 1 and a vicinity of the upper end of the main body part 11 that is continuous therewith. On the other hand, the second region 42 is attached to an area corresponding to a vicinity of the center from the left end portion of the upper edge part 13 of the inner panel 1. Accordingly, a vicinity of the upper end of the main body part 11, both side edge parts 12, and the upper edge part 13 of the inner panel 1 are reinforced by the two reinforcing frames 4.

The inner panel 1, the upper panel 21, the lower panel 22, and the reinforcing frames 4 are formed from a resin material. For example, a carbon fiber reinforced resin (CFRP) can be employed. The lower panel 22, however, contributes little to the rigidity of the backdoor, and can thus be formed from a resin material such as polypropylene. Note that at least some of the parts constituting the backdoor, such as the inner panel 1, the outer panel 2 and the reinforcing frames 4, can also be formed from a metal.

Note that although the attachment angle θ (refer to FIG. 2) of the rear glass 3 fitted in the opening part is not particularly limited, the rear glass is, for example, preferably attached at an angle of 45 degrees or more from a horizontal direction H, and is more preferably attached at 45 to 70 degrees.

2. Summary of Rear Glass

Figure 4:
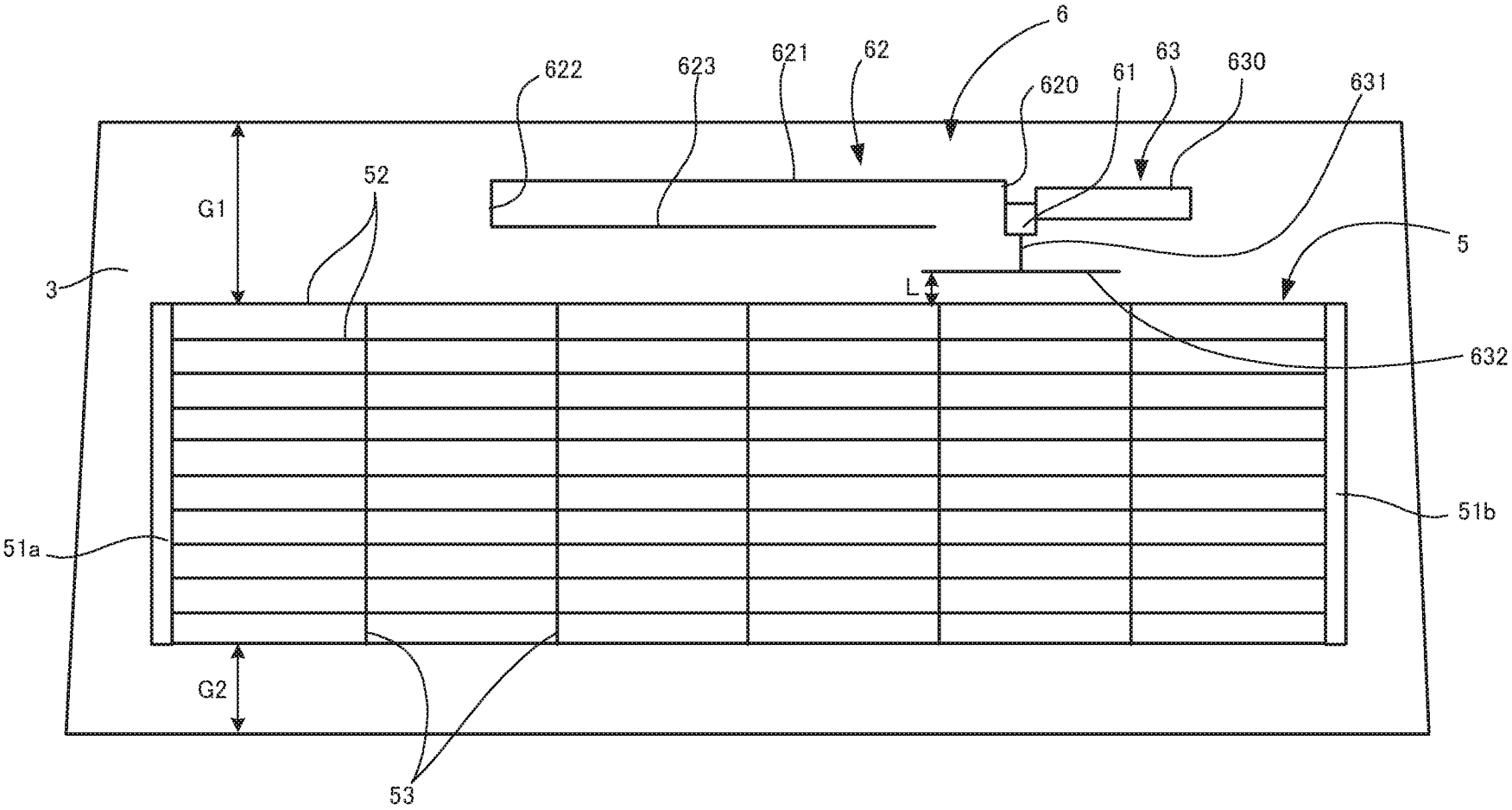
FIG. 4 is a front view of a rear glass of the backdoor in FIG. 1.

Next, the rear glass 3 will be described, with reference to FIG. 4. FIG. 4 is a front view of the rear glass. As shown in FIG. 4, this rear glass 3 is rectangularly formed, and is fixed to the inner panel 1 and the reinforcing frames 4 by a fastening material (illustration omitted) or the like, between the upper panel 21 and the lower panel 22 that are disposed in the up-down direction. A defogger 5 and an AM/FM shared antenna 6 are mounted on the rear glass 3. Hereinafter, these members will be described in order.

2-1. Glass Plate

A known glass plate for automobiles can be utilized for the rear glass 3. For example, heat absorbing glass, common clear glass, common green glass or UV green glass may be utilized as the glass plate. Such a glass plate needs, however, to realize a visible light transmittance in line with safety standards of the country in which the automobile will be used. For example, solar absorbance, visible light transmittance and the like can be adjusted to meet safety standards. Hereinafter, an example of the composition of clear glass and an example of the composition of heat absorbing glass will be shown.

Clear Glass $SiO_2$: 70 to 73 mass %

$Al_2O_3$: 0.6 to 2.4 mass %

CaO: 7 to 12 mass %

MgO: 1.0 to 4.5 mass %

$R_2O$: 13 to 15 mass % (R is an alkaline metal)

Total iron oxide in terms of $Fe_2O_3$(T-$Fe_2O_3$): 0.08 to 0.14 mass %

Heat Absorbing Glass

The composition of heat absorbing glass can, for example, be given as a composition, based on the composition of clear glass, including total iron oxide in terms of $Fe_2O_3$ (T-$Fe_2O_3$) at a ratio of 0.4 to 1.3 mass %, $CeO_2$ at a ratio of 0 to 2 mass %, and $TiO_2$ at a ratio of 0 to 0.5 mass %, and in which the skeletal component (mainly $SiO_2$ or $Al_2O_3$) of the glass is reduced by an amount equivalent to the increase in T-$Fe_2O_3$, $CeO_2$ and $TiO_2$.

Note that the type of glass plate is not limited to clear glass or heat absorbing glass, and is selectable as appropriate according to the embodiment. For example, the glass plate may be a resin window made of acrylic resin, polycarbonate resin or the like.

Also, this rear glass 3 is formed in a curved shape as appropriate, so as to follow the shape of the inner panel 1. Such a rear glass 3, apart from being constituted by a single glass plate, may be a laminated glass in which an intermediate film such as a resin film is sandwiched by a plurality of plates of glass.

2-2. Defogger

Next, the defogger 5 will be described. As shown in FIG. 4, the defogger 5 is disposed in a vicinity of the center of the rear glass 3 in the up-down direction, and is formed so as to extend across the entirety of the rear glass 3 in the left-right direction. Specifically, this defogger 5 includes a pair of bus bars 51*a* and 51*b* for power supply that respectively extend in the up-down direction along both side edges of the rear glass 3. Between both bus bars 51*a* and 51*b*, a plurality of heating wires 52 that extend in the horizontal direction are disposed in parallel at a predetermined interval, and heat for defogging is produced by power supply from the bus bars 51*a* and 51*b*. Furthermore, five vertical wires 53 that extend in the up-down direction so as to intersect the plurality of heating wires 52 are provided. These five vertical wires 53 are disposed at equal intervals between both bus bars 51*a* and 51*b*.

Also, a distance G1 between an upper edge of the inner periphery of the backdoor to which the rear glass 3 is attached and an uppermost portion (heating wire 52 disposed most upward) of the defogger 5 can be set to 40 to 100 mm. Similarly, a distance G2 between a lower edge of the inner periphery of the backdoor and a lowermost portion (heating wire 52 disposed most downward) of the defogger 5 can also be set to 40 mm to 100 mm, for example. Also, the length of the defogger 5 in the up-down direction is not particularly limited, and can be set to 200 mm to 400 mm, for example. Alternatively, the length of the defogger 5 in the up-down direction can also be set to a length that is 65 to 85% of the length of the rear glass 3 in the up-down direction.

2-3. Shared Antenna

Next, the shared antenna 6 will be described. As shown in FIG. 4, this shared antenna 6 receives both AM and FM broadcast waves, and is disposed upward of the defogger 5. Specifically, the shared antenna 6 is provided with a power supply unit 61 that is disposed upward of the defogger 5 and an AM antenna 62 and an FM antenna 63 that extend from this power supply unit 61. The AM antenna 62 is provided with an auxiliary element 620 that extends slightly upward from the power supply unit 61, a first AM antenna element 621 that extends in the horizontal direction toward the left side from this auxiliary element 620, a second AM antenna element 622 that extends downward from the left end portion of this first AM antenna element 621, and a third AM antenna element 623 that extends in the horizontal direction toward the right side from the lower end portion of this second AM antenna element 622. The second AM antenna element 622 extends to a vicinity of the lower end of the power supply unit 61 in the up-down direction, and the third AM antenna element 623 extends to a vicinity of the power supply unit 61 in the horizontal direction. In this way, in the AM antenna 62, the second AM antenna element 622 and the third AM antenna element 623 constitute a folded portion.

On the other hand, the FM antenna 63 is provided with a rectangular frame-shaped FM main body element 630 that is coupled to the power supply unit 61 and extends in the horizontal direction toward the right side, a first FM antenna element 631 that extends downward from the power supply unit 61, and a second FM antenna element 632 that is coupled to a lower end portion of the first FM antenna element 631 and extends in the horizontal direction. The first FM antenna element 631 and the second FM antenna element 632 are formed in an inverted T-shape. A gap is formed between the second FM antenna element 632 and the heating wire 52 of the uppermost portion of the defogger 5, with a length L of this gap in the up-down direction preferably being 5 to 40 mm, and a length of the second antenna element 632 preferably being 100 to 300 mm. Also, the length L is more preferably 15 to 40 mm, and the second antenna element 632 is more preferably 200 to 500 mm. Furthermore, the length L is even more preferably 30 to 40 mm, and the second antenna element 632 is even more preferably 400 to 1000 mm. The second FM antenna element 632 and the defogger 5 are thereby constituted to be capacitively coupled. Since the possibility of noise being superimposed on AM broadcast waves due to the defogger 5 decreases as the length L increases, the length L is preferably longer. On the other hand, lengthening the second FM antenna element 632 facilitates capacitive coupling of the second FM antenna element 632 and the defogger 5. Also, due to the above configuration, the FM antenna 63 is positioned closer to the defogger 5 than is the AM antenna 62.

Also, the automobile is provided with a receiver for AM and FM (illustration omitted) and an amplifier (illustration omitted) connected thereto, and a cable (illustration omitted) connected to the amplifier is electrically connected to the power supply unit 61.

2-4. Element Length of AM Antenna

Figure 5:
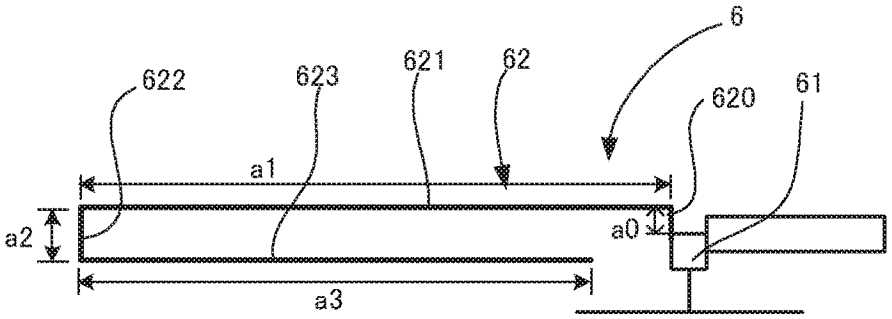
FIG. 5 is an enlarged view of a shared antenna according to a first pattern.

With the shared antenna 6 according to this embodiment, it was discovered that the influence of the AM antenna 62 on the reception performance of the FM antenna 63 can be reduced by adjusting the element length of the AM antenna 62 as follows. This point will be described with reference to FIG. 5. FIG. 5 is an enlarged plan view of the shared antenna.

As shown in FIG. 5, an element length $L_{AM}$ of the AM antenna 62 indicates the total length of the auxiliary element 620 and the first to third AM antenna elements 621 to 623. Here, the respective lengths of the auxiliary element 620 and the first to third AM antenna elements 621 to 623 are given as a0, a1, a2 and a3, and the total length thereof is given as the element length $L_{AM}$ (=a0+a1+a2+a3) of the AM antenna. When this element length $L_{AM}$ is adjusted as in the following inequation (1) with respect to a center wavelength $\lambda_{FM\text{-}C}$ corresponding to the reception frequency (e.g., 76 to 108 MHz) of the FM antenna 63 and a wavelength shortening coefficient $\alpha$ of the glass plate 3, the influence on the reception performance of the FM antenna 63 can be reduced. That is, it was discovered that a reduction in the reception performance of the FM antenna 63 can be suppressed.

$$0.49\times\alpha\times\lambda_{FM\text{-}C}\leq L_{AM}\leq 0.67\times\alpha\times\lambda_{FM\text{-}C} \quad (1)$$

Note that the wavelength shortening coefficient $\alpha$ of the glass plate 3 is also changed depending on factors such as the composition of the glass plate, and is approximately 0.5 to 0.7, for example. In the present application, 0.61 is used as a typical value in some calculations.

Although various patterns are conceivable for the AM antenna 62 other than FIG. 5, it was discovered that, in applying inequation (1), the element length La can be defined as follows. Hereinafter, other patterns of the AM antenna 62 will be described. Note that, for convenience of description, the AM antenna in FIG. 5 will be referred to as a first pattern.

Figure 6:
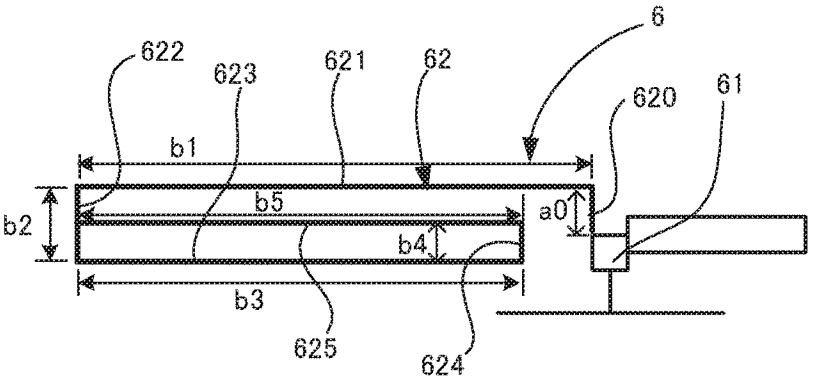
FIG. 6 is an enlarged view of a shared antenna according to a second pattern.

FIG. 6 shows a second pattern of the AM antenna 62. The second pattern is provided with, additionally to the first pattern, a fourth AM antenna element 624 that extends upward from the right end portion of the third AM antenna element 623, and a fifth AM antenna element 625 that extends on the left side in the horizontal direction from the upper end portion of the fourth AM antenna element 624. The fourth AM antenna element 624 extends on the first AM antenna element 621 side in the up-down direction, but does not contact the first AM antenna element 621. Also, the left end portion of the fifth AM antenna element 625 contacts the second AM antenna element 622. That is, a rectangular loop is formed by the second to fifth AM antenna elements 622 to 625. In this second pattern, although the respective lengths of the auxiliary element 620 and the first to fifth AM antenna elements 621 to 625 are defined as b0, b1, b2, b3, b4 and b5, the element length $L_{AM}$ of the AM antenna 62 is defined as the total length of b0, b1, b2 and b3. That is, b4 and b5 are not included in the element length LA.

Figure 7:
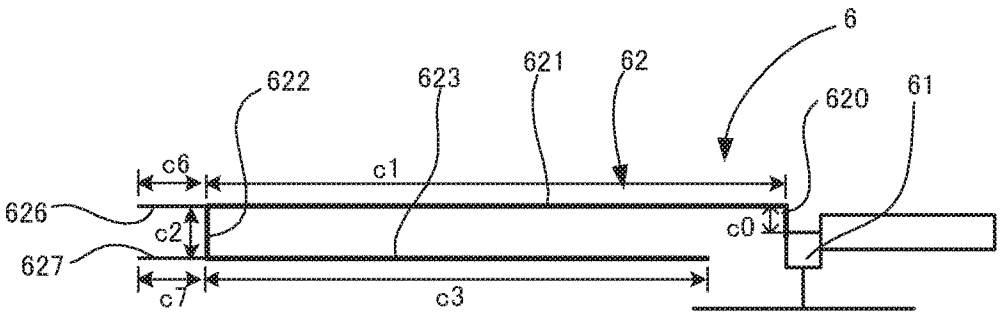
FIG. 7 is an enlarged view of a shared antenna according to a third pattern.

FIG. 7 shows a third pattern of the AM antenna. The third pattern is provided with, additionally to the first pattern, a short sixth AM antenna element 626 that extends in the horizontal direction toward the left side from the upper end portion of the second AM antenna element 622, and a short seventh AM antenna element 627 that extends in the horizontal direction toward the left side from the lower end portion of the second AM antenna element 622. The lengths of the sixth and seventh AM antenna elements 626 and 627 are the same. In this third pattern, although the respective lengths of the auxiliary element 620, the first to third AM antenna elements 621 to 623 and the sixth and seventh AM antenna elements 626 and 627 are given as c0, c1, c2, c3, c6 and c7, the element length LA of the AM antenna is defined as the total length of c0, c1, c2 and c3. That is, c6 and c7 are not included in the element length LA.

Figure 8:
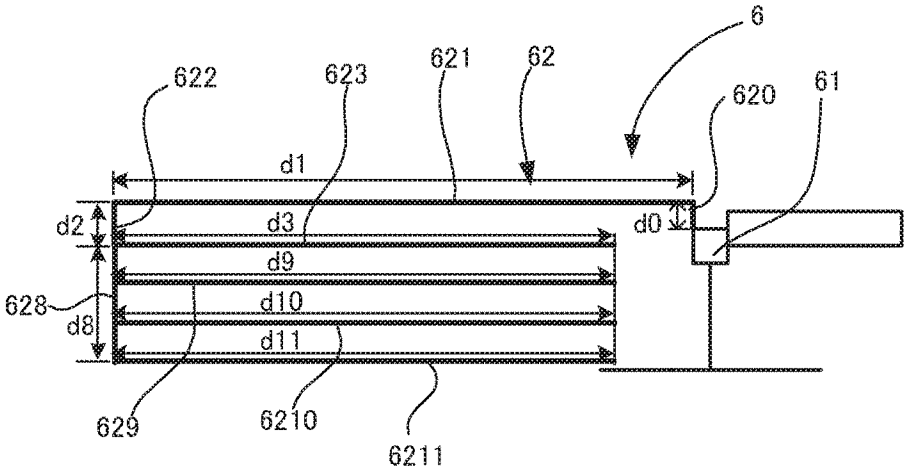
FIG. 8 is an enlarged view of a shared antenna according to a fourth pattern.

FIG. 8 shows a fourth pattern of the AM antenna 62. The fourth pattern is provided with, additionally to the first pattern, an eighth AM antenna element 628 that extends downward from the lower end portion of the second AM antenna element 622, and ninth to eleventh AM antenna elements 629 to 6211 that extends in parallel in the horizontal direction toward the right side from this eighth AM antenna element 628. The third and ninth to eleventh AM antenna elements 623 and 629 to 6211 are aligned in the up-down direction with the same length and at equal intervals, and the eleventh AM antenna element 629 extends from the lower end portion of the eighth AM antenna element 628. In this fourth pattern, although the respective lengths of the auxiliary element 620, the first to third and eighth to eleventh AM antenna elements 621 to 623 and 628 to 6211 are d0, d1, d2, d3, d8, d9, d10 and d11, the element length $L_{AM}$ of the AM antenna 62 is defined as the total length of d0, d1, d2 and d3. That is, d8 to d11 are not included in the element length LA. Note that, in this fourth pattern, the number of elements extending on the right side from the second AM antenna element 622 or the eighth AM antenna element 628 is given as four, but the number and length thereof are particularly not limited.

Note that the auxiliary element 620 is not necessarily required and need not be provided. Also, the length of each AM antenna element is not particularly limited, and can be changed as appropriate. The first to fourth patterns all use, as a basic pattern, a structure having the first AM antenna element 621 that extends horizontally from the power supply unit and the second and third AM antenna elements 622 and 623 (folded portion) that double back from the end portion thereof to the power supply unit side, but as long as this shape is provided, the element length $L_{AM}$ will be the total length of the first to third AM antenna elements 621 to 623, and the length of the auxiliary element 620 can be added if necessary.

Also, although the length (e.g., a2) of the AM antenna 62 in the up-down direction is not particularly limited, it is advantageous, in the case where the area between the defogger 5 and the upper end portion of the glass plate 3 is small, such as with the rear glass 3 that is provided on a lift-up backdoor, if this length is 50 mm or less, preferably 40 mm or less, and more preferably 30 mm or less, for example.

2-5. Materials

A defogger 5 and shared antenna 6 such as the above are constituted by assembling together wire rods, and these members can be formed by laminating a conductive material having conductivity on the surface of the rear glass 3 so as to have a predetermined pattern. Such a material need only have conductivity, and is selectable as appropriate according to the embodiment, with silver, gold, platinum and the like given as examples. Specifically, these members can be formed by, for example, printing and baking a conductive silver paste containing silver powder, glass frit and the like on the surface of the rear glass 3.

3. Features

According to this embodiment, as described above, the following effects can be obtained.

(1) In the shared antenna 6, the element length $L_{AM}$ of the AM antenna 62 is configured to satisfy inequation (1), thus enabling a reduction in the reception performance of the FM antenna 63 to be suppressed. That is, even when the shared antenna 6 has the AM antenna 62 and the FM antenna 63, the AM antenna 62 can be prevented from affecting the reception performance of the FM antenna 63. Note that the FM antenna 63 generally exerts very little influence on the reception performance of the AM antenna 62. Accordingly, as long as inequation (1) is satisfied, the AM antenna 62 and the FM antenna 63 can be individually designed, and flexibility of design can be improved. As a result, the reception performance of both the AM antenna 62 and the FM antenna 63 in the shared antenna 6 can be improved.

(2) The area of the AM antenna 62 increases when the AM antenna 62 has a loop region such as with the second pattern, thus enabling the reception sensitivity of AM broadcast waves to be improved.

(3) The second FM element 632 of the FM antenna 63 is capacitively coupled to the defogger 5, thus enabling the reception sensitivity of FM broadcast waves to be improved.

4. Variations

Although an embodiment of this invention has been described above, the invention is not limited to the foregoing embodiment, and various changes can be made without departing from the gist of the invention. Note that the following variations can be combined as appropriate.

Figure 9:
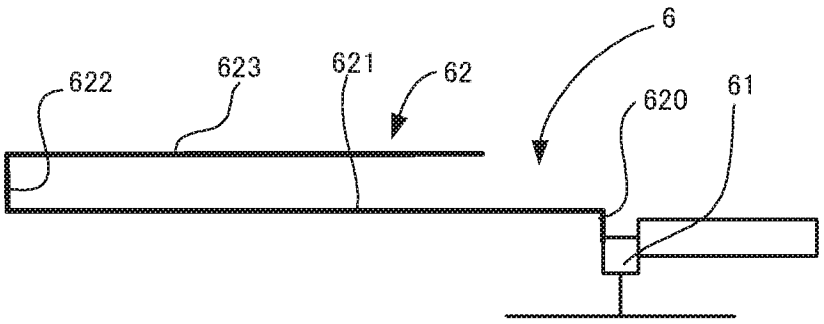
FIG. 9 is a plan view showing another example of a shared antenna.

4-1. The patterns of the AM antenna 62 of the shared antenna 6 are examples, and the number, length, shape, direction and the like of the elements are not particularly limited, and can be configured in various forms. For example, the first pattern of the AM antenna 62 of the above embodiment is folded downward but may be folded upward, as shown in FIG. 9. This similarly applies to the second to fourth patterns.

4-2. The configuration of the FM antenna 63 is not particularly limited, and, for example, the FM main body element 630 can also be formed in another shape rather than a frame shape, such as at least a single line shape. Alternatively, the FM antenna 63 can also be constituted by only the first and second FM antenna elements 631 and 632, without providing the FM main body element 630. The shape of the first and second FM antenna elements 631 and 632 can be changed to be L-shaped or the like, for example, and other elements can also be provided. Alternatively, an FM sub-antenna in which an element extends from another power supply unit different from the power supply unit 61 can also be provided.

Figure 10:
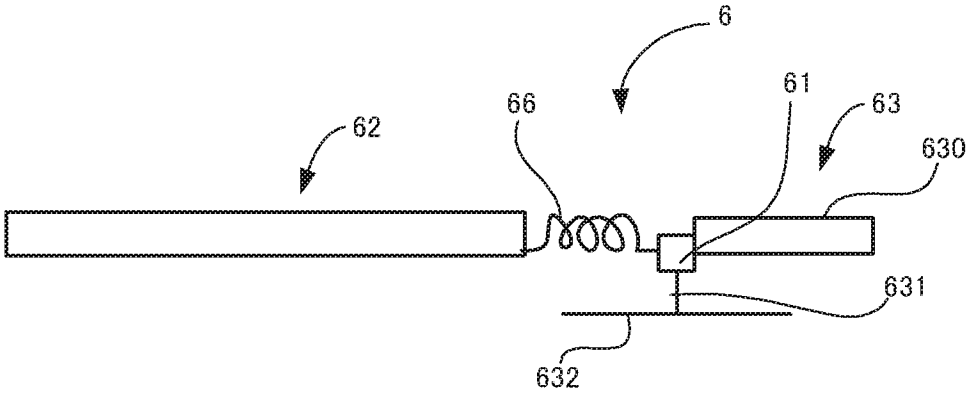
FIG. 10 is a plan view showing another example of a shared antenna.

4-3. In the above embodiment, the element length LA of the AM antenna 62 is adjusted so as to not affect the reception performance of the FM antenna 63, but a configuration such as shown in FIG. 10, for example, can be adopted so as to not affect the reception performance of the FM antenna 63. In the example in FIG. 10, a loop-shaped AM antenna 62 is provided, and a coil 66 is disposed between this AM antenna 62 and the power supply unit 61. The AM antenna 62 can thereby be prevented from affecting the FM antenna 63. The coil 66 used here is an FM choke coil having a function of blocking AC current in a high-frequency manner in the FM band and allowing AC current in the AM band, and the inductance thereof is preferably 1 to 10 μH, for example. Also, even in the case of using the coil 66, the shape and the like of the AM antenna 62 and the FM antenna 63 can be changed as appropriate as described above.

4-4. In the above embodiment, the second FM antenna element 632 is disposed in a position nearer the defogger 5 than is the AM antenna 62, but the distance between the defogger 5 and the AM antenna 62 may be the same as the distance between the defogger 5 and the second FM antenna element 652. For example, the second FM antenna element 632 and the third AM antenna element 623 may be disposed the same distance from the defogger 5 by being aligned linearly. In this case, the third AM antenna element 623 need only be partially rather than entirely aligned linearly with the second FM antenna element 632.

4-5. Also, in the above embodiment, the shared antenna 6 is disposed more upward than is the defogger 5, but may be disposed downward of the defogger 5.

4-6. Antennas related to other media, such as a digital television antenna and a DAB antenna, for example, can also be provided.

4-7. The shape of the defogger 5 is also not particularly limited, and a configuration need only be adopted in which at least the bus bars 51*a* and 51*b* are respectively disposed on both sides and a plurality of horizontal heating wires 52 joining these bus bars 51*a* and 51*b* are provided. Also, the number and position of the vertical wires 53 are not particularly limited, and may be other than five and need not be disposed at equal intervals. A configuration can also be adopted in which the vertical py 53 are not provided.

4-8. The backdoor is not particularly limited in shape, and need only have a resin panel, and an opening part in which the rear glass 3 is fitted need only be formed in this resin panel. Accordingly, a configuration can also be adopted in which the backdoor has a single resin panel formed by integrating the upper panel and the lower panel, or, furthermore, has a plurality of panels, for example.

Also, the panels constituting the backdoor are preferably all formed from a resin material from the viewpoint of the reception sensitivity of the antennas, but a region of at least some panels may be formed from a metal. For example, the reinforcing frames can be formed from a metal and at least some of the other panels can also be formed from a metal.

4-9. The amplifier may be disposed on the glass plate 3, other than being provided in the vehicle interior. Also, the amplifier may be omitted, and the power supply unit and the receiver may be directly connected.

WORKING EXAMPLES

Hereinafter, working examples of this invention will be described. The invention is, however, not limited to the following working examples.

1. Investigations Relating to Element Length of AM Antenna

In the following investigations of reception performance, three dimensional electromagnetic simulation software (Time Domain 3D EM simulation software) was used. In this simulation, a glass plate was modeled, assuming a typical tempered glass having a thickness of 3.1 mm. Also, a model was configured in which the line width of the defogger and the antenna elements was given as 1 mm, and the shortening coefficient of the glass plate was given as 0.61. As the simulation procedure, simulation was executed, after having (1) modeled the vehicle, dielectric body, antennas and the like and set the materials, and (2) set an appropriate mesh for the vehicle, dielectric body, antennas and the like. Such setting and execution of the simulation was common to the investigations of all the working examples and comparative examples shown below.

Figure 11:
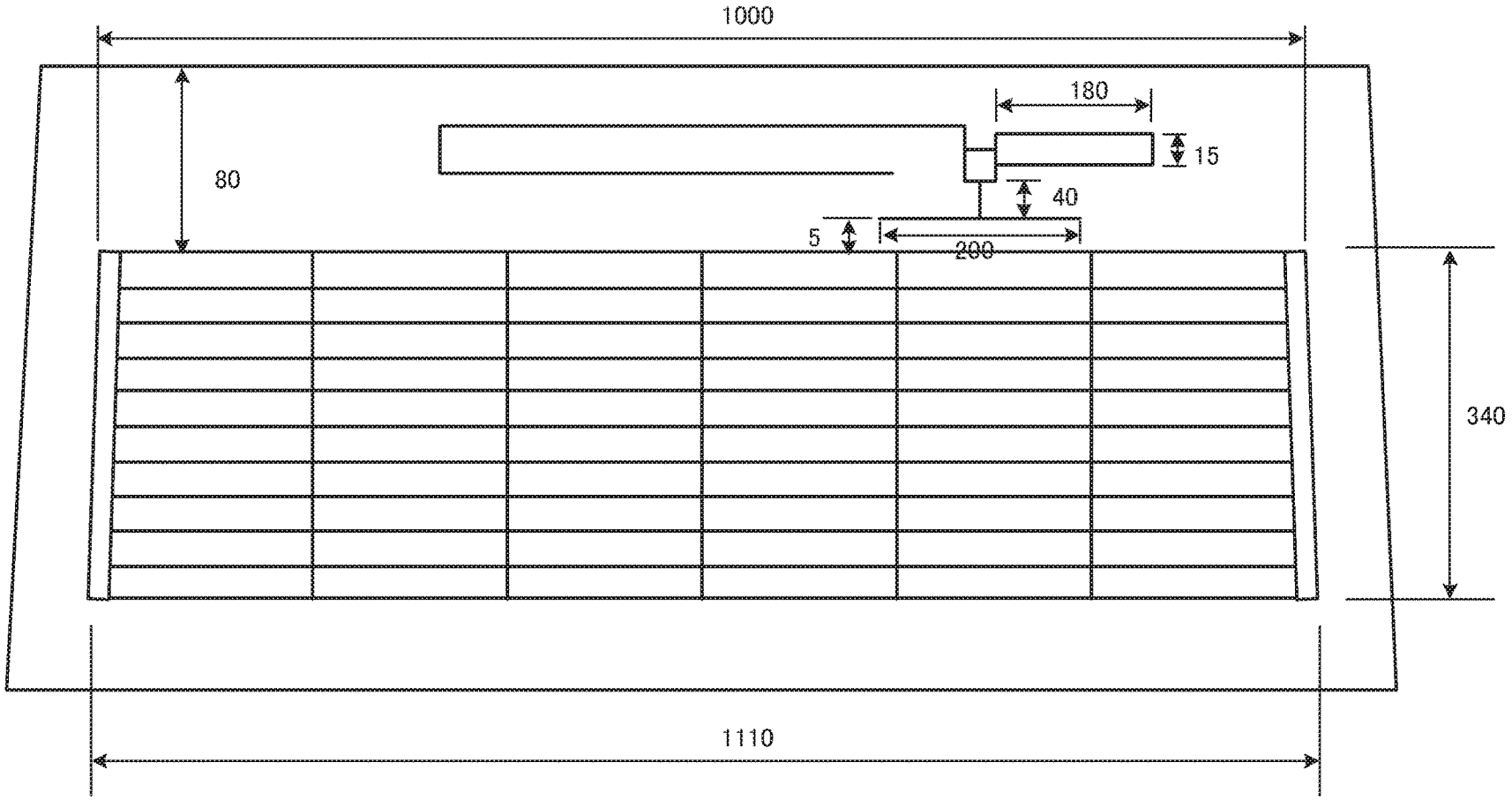
FIG. 11 is a plan view of a rear glass according to working examples and comparative examples.
Figure 12:
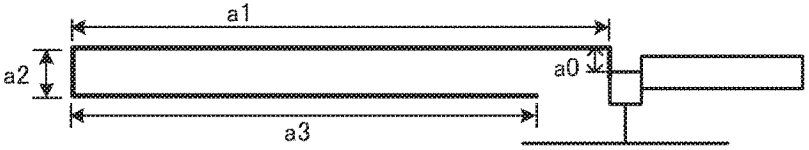
FIG. 12 is a plan view showing a shared antenna according to working examples and comparative examples.

A rear glass shown in FIG. 11 was modeled. This rear glass has a similar configuration to FIG. 4 described in the above embodiment (numerical values in FIG. 11 are in units of mm). Also, in this rear glass, a shared antenna was formed as follows as working examples 1 to 7 and comparative examples 1 to 4 (for a0 to a3, refer to FIG. 12). Also, a rear glass in which the AM antenna was omitted from the shared antenna was prepared as a reference example.

TABLE 1

| | a0 | a1 | a2 | a3 | Element Length $L_{AM}$ |
|---|---|---|---|---|---|
| Working Ex. 1 | 5 mm | 630 mm | 20 mm | 628 mm | 1283 mm |
| Working Ex. 2 | 5 mm | 605 mm | 20 mm | 603 mm | 1233 mm |
| Working Ex. 3 | 5 mm | 580 mm | 20 mm | 578 mm | 1183 mm |
| Working Ex. 4 | 5 mm | 555 mm | 20 mm | 553 mm | 1133 mm |
| Working Ex. 5 | 5 mm | 530 mm | 20 mm | 528 mm | 1083 mm |
| Working Ex. 6 | 5 mm | 505 mm | 20 mm | 503 mm | 1033 mm |
| Working Ex. 7 | 5 mm | 480 mm | 20 mm | 478 mm | 983 mm |
| Comparative Ex. 1 | 5 mm | 680 mm | 20 mm | 678 mm | 1383 mm |
| Comparative Ex. 2 | 5 mm | 680 mm | 20 mm | 628 mm | 1333 mm |
| Comparative Ex. 3 | 5 mm | 455 mm | 20 mm | 453 mm | 933 mm |
| Comparative Ex. 4 | 5 mm | 430 mm | 20 mm | 428 mm | 883 mm |
| Reference Ex. | AM antenna omitted | | | | |

Simulation was performed with regard to the reception IC-1T sensitivity in the FM frequency band (76 to 108 MHz) of the shared antenna in the case where the rear glass according to working examples 1 to 7, comparative examples 1 to 4 and the reference example was attached to the lift-up backdoor of a vehicle. That is, reception sensitivity was simulated for the case where radio waves (vertically polarized waves, horizontally polarized waves, diagonally polarized waves, etc.) were emitted toward the vehicle. Reception sensitivity was calculated using the simulation results for a dipole antenna modeled so as to have matching impedance for every frequency, by correcting these results. The conditions at the time of measurement were as follows.

Attachment angle of rear glass on which antenna was mounted: 23 degree inclination relative to horizontal direction Angular resolution: measurement performed every angle of three degrees while rotating automobile through 360 degrees Elevation angle between emission position of radio waves and antenna: 1.9 degrees (where ground and horizontal direction are 0 degrees, and zenith direction is 90 degrees)

Also, the wavelength shortening coefficient of the rear glass used here was set to 0.61 as described above, and inequation (1) was investigated using this value, as will be described later.

Figure 13:
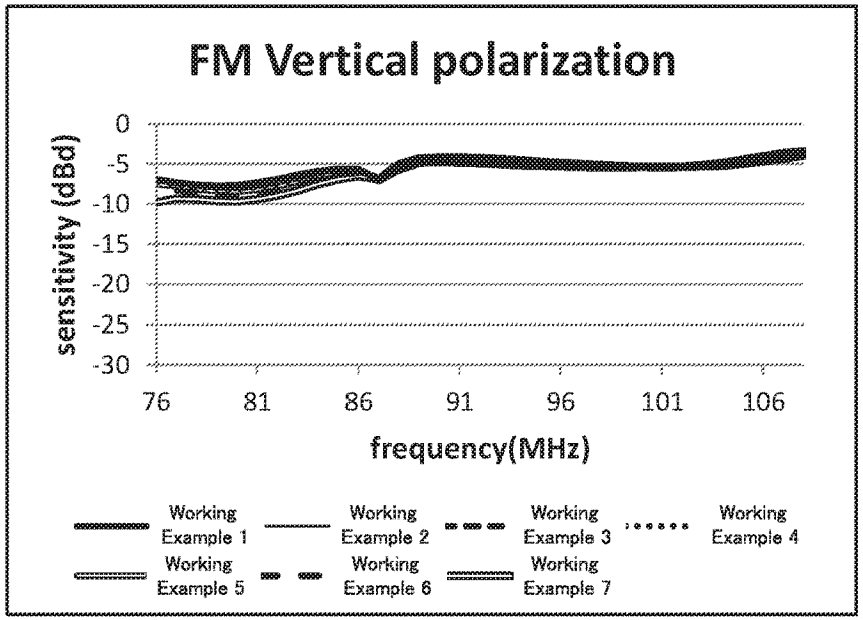
FIG. 13 is a graph showing the reception performance of FM antennas according to working examples 1 to 7.
Figure 14:
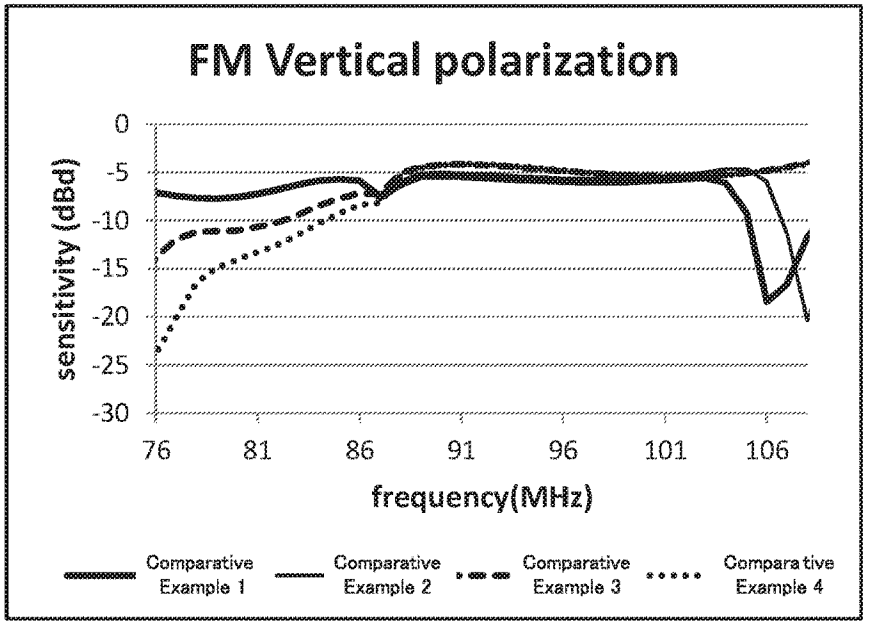
FIG. 14 is a graph showing the reception performance of FM antennas according to comparative examples 1 to 4.
Figure 15:
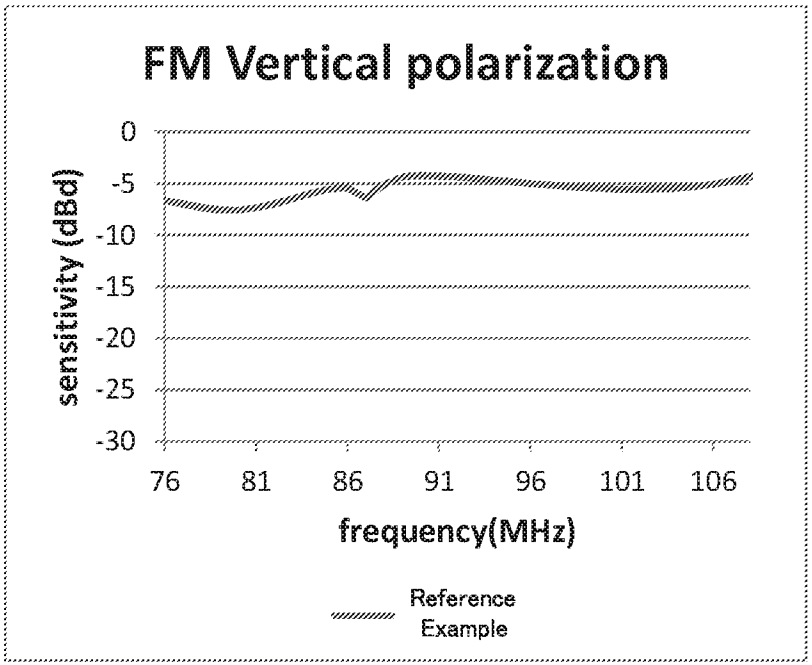
FIG. 15 is a graph showing the reception performance of an FM antenna according to a reference example.

The results are as shown in FIGS. 13 to 15 and Table 2. FIGS. 13 to 15 respectively show the reception sensitivity of the FM antenna in working examples 1 to 7, comparative examples 1 to 4, and the reference example. Also, Table 2 shows the average reception sensitivity of FM broadcast waves in the 76 to 108 MHz frequency band. The average reception sensitivity of FM broadcast waves was calculated by averaging the reception sensitivity every 1 MHz in the 76 to 108 MHz frequency band. As shown in FIG. 13, FIG. 15 and Table 2, the reception sensitivity of FM broadcast waves hardly decreases for all of working examples 1 to 7, compared with the reference example in which the FM antenna was individually provided. On the other hand, as shown in FIG. 14, comparative examples 1 and 2 both exhibit large drop offs on a relatively high frequency side of the frequency band of FM broadcast waves, and comparative examples 3 and 4 both exhibit large drop offs on a relatively low frequency side of the frequency band of FM broadcast waves. As shown in FIGS. 14 and 15, comparative examples 1 to 4 all exhibit a decrease in the reception sensitivity of FM broadcast waves, compared with the reference example in which the FM antenna was individually provided.

TABLE 2

| | Avg. Reception Sensitivity in 76 to 108 MHz Band |
|---|---|
| Working Ex. 1 | −5.7 dBd |
| Working Ex. 2 | −5.6 dBd |
| Working Ex. 3 | −5.7 dBd |
| Working Ex. 4 | −5.7 dBd |
| Working Ex. 5 | −5.8 dBd |
| Working Ex. 6 | −5.9 dBd |
| Working Ex. 7 | −6.2 dBd |
| Comparative Ex. 1 | −7.2 dBd |
| Comparative Ex. 2 | −6.6 dBd |
| Comparative Ex. 3 | −6.7 dBd |
| Comparative Ex. 4 | −8.0 dBd |
| Reference Ex. | −5.6 dBd |

Here, the wavelength ($\lambda_{FM\text{-}C}$) at the center frequency (92 MHz) in the 76 to 108 MHz band is 3582 mm, and 974 mm$\leq L_{AM} \leq$1332 mm from inequation (1). Thus, as shown in Table 1, the element length $L_{AM}$ of the AM antenna of working examples 1 to 7 satisfies inequation (1). On the other hand, the element length $L_{AM}$ of the AM antenna of comparative examples 1 to 4 does not satisfy inequation (1). Accordingly, it was found that an AM antenna having an element length that satisfies inequation (1) does not affect the reception performance of the FM antenna.

Note that, in this invention, it was investigated whether reception of AM broadcast waves was possible with only an FM antenna (reference numerals 63 (630, 631, 632) in FIG. 4) in the shared antenna. Here, a reference working example and the abovementioned reference example were prepared as follows.

TABLE 3

| | a0 | a1 | a2 | a3 | Element Length $L_{AM}$ |
|---|---|---|---|---|---|
| Ref. Working Ex. | 5 mm | 620 mm | 20 mm | 600 mm | 1245 mm |
| Reference Ex. | AM antenna omitted (a0 to a3 = 0 mm) | | | | |

Figure 16:
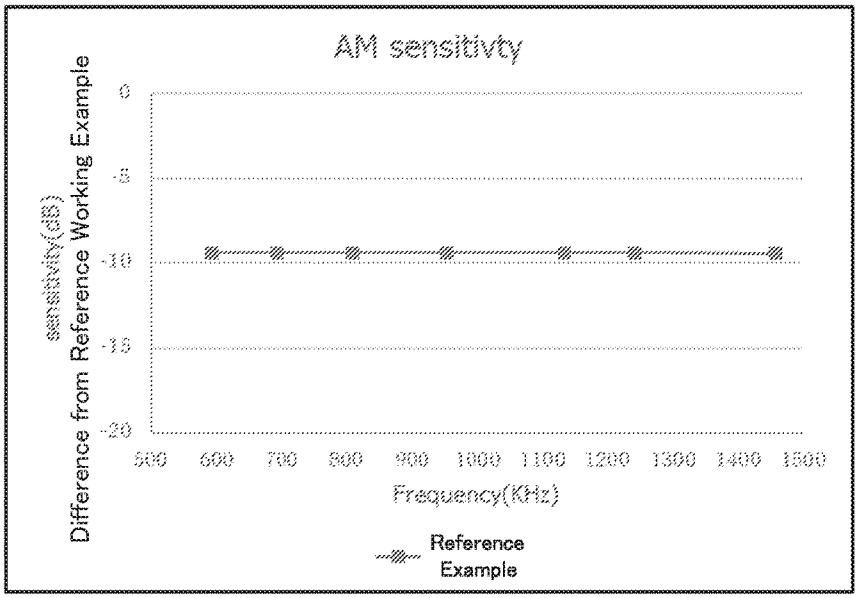
FIG. 16 is a graph showing the reception performance of an AM antenna according to the reference example.

Simulation was performed with regard to the reception sensitivity in the AM frequency band (500 to 1500 kHz) of the shared antenna with a simulation method similar to that described above. The results are as shown in FIG. 16. FIG. 16 shows the reception sensitivity of the reference example based on the reference working example. That is, the difference from the reference working example is shown. According to these results, it was found that, at all frequencies, the reception sensitivity of AM broadcast waves decreases at and above 9 dB in the reference example. Accordingly, in a mode in which an AM antenna is not provided, as with the reference example, an extreme decrease in the reception sensitivity of AM broadcast waves occurs, and thus it was found that an FM antenna (reference numerals 63 (630, 631, 632) in FIG. 4) by itself hardly functions as an AM antenna.

Figure 17:
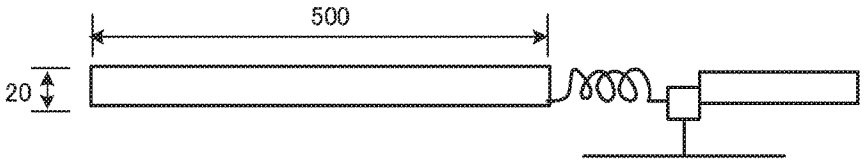
FIG. 17 is a plan view showing a shared antenna according to working example 8.
Figure 18:
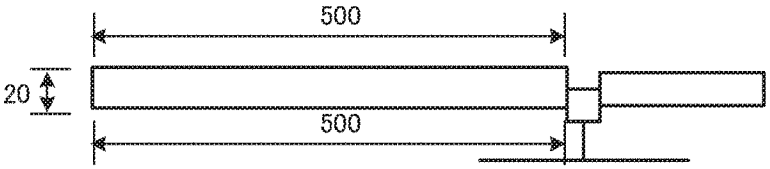
FIG. 18 is a plan view showing a shared antenna according to comparative example 5.

2. Examinations relating to Mode in which AM Antenna and Power Supply Part are connected with Coil Working example 8 having a shared antenna shown in FIG. 17 was prepared. The dimensions of components such as the defogger and the FM antenna are the same as the abovementioned working example 1 and the like. As shown in FIG. 17, in this working example 8, the AM antenna and the power supply unit are connected with a coil having an inductance of 4.7 μH. Also, as comparative example 5, a shared antenna in which the same AM antenna was directly connected to the power supply unit rather than via a coil was modeled, as shown in FIG. 18. Apart from not using a coil, comparative example 5 and working example 8 have generally the same configuration.

Figure 19:
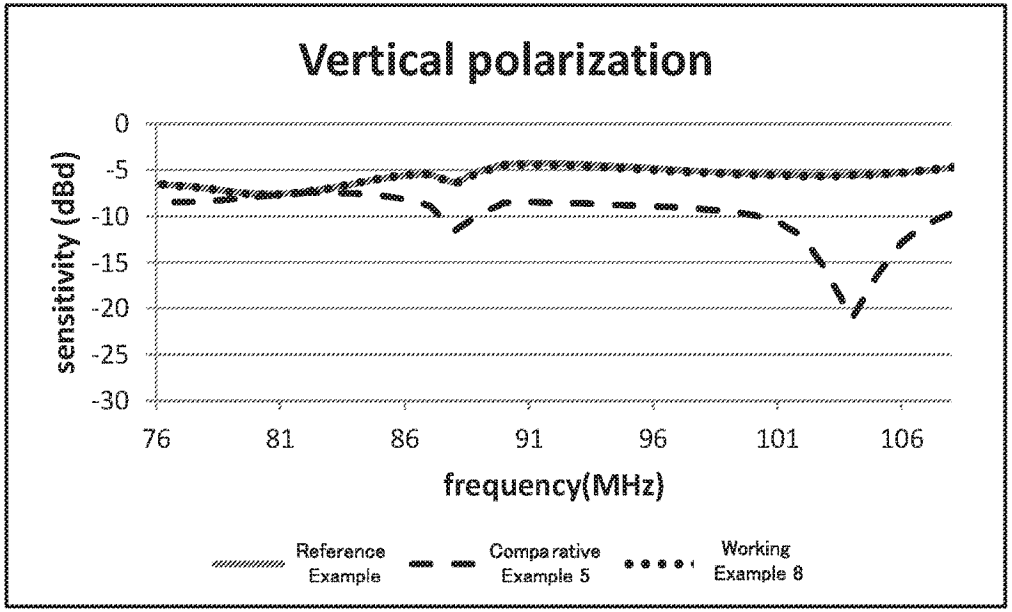
FIG. 19 is a graph showing the reception performance of FM antennas according to working example 8, comparative example 5, and the reference example.

The reception performance of working example 8 and comparative example 5 was measured similarly to the above examinations. The results are as shown in FIG. 19. FIG. 19 shows the reception sensitivity of vertically polarized waves in the FM antenna of the shared antenna. As shown in FIG. 19, with working example 8, it was found that the reception sensitivity of the FM broadcast waves hardly decreases, compared with the reference example in which the FM antenna was provided individually. Also, the average reception sensitivity in the 76 to 108 MHz band was −5.7 dBd. Accordingly, even in the case where the AM antenna and the power supply unit are connected with a coil, it was found that the reception performance of the FM antenna is not affected. On the other hand, comparative example 5 is considered to be equivalent to a copper foil that is 20 mm wide and 500 mm long, and is thus an AM antenna whose element length is 500 mm, and inequation (1) is not satisfied. Accordingly, it was found that the reception performance is greatly inferior as compared with the reference example and working example 8.

3. Examinations Relating to Shape of FM Antenna

Figure 20:
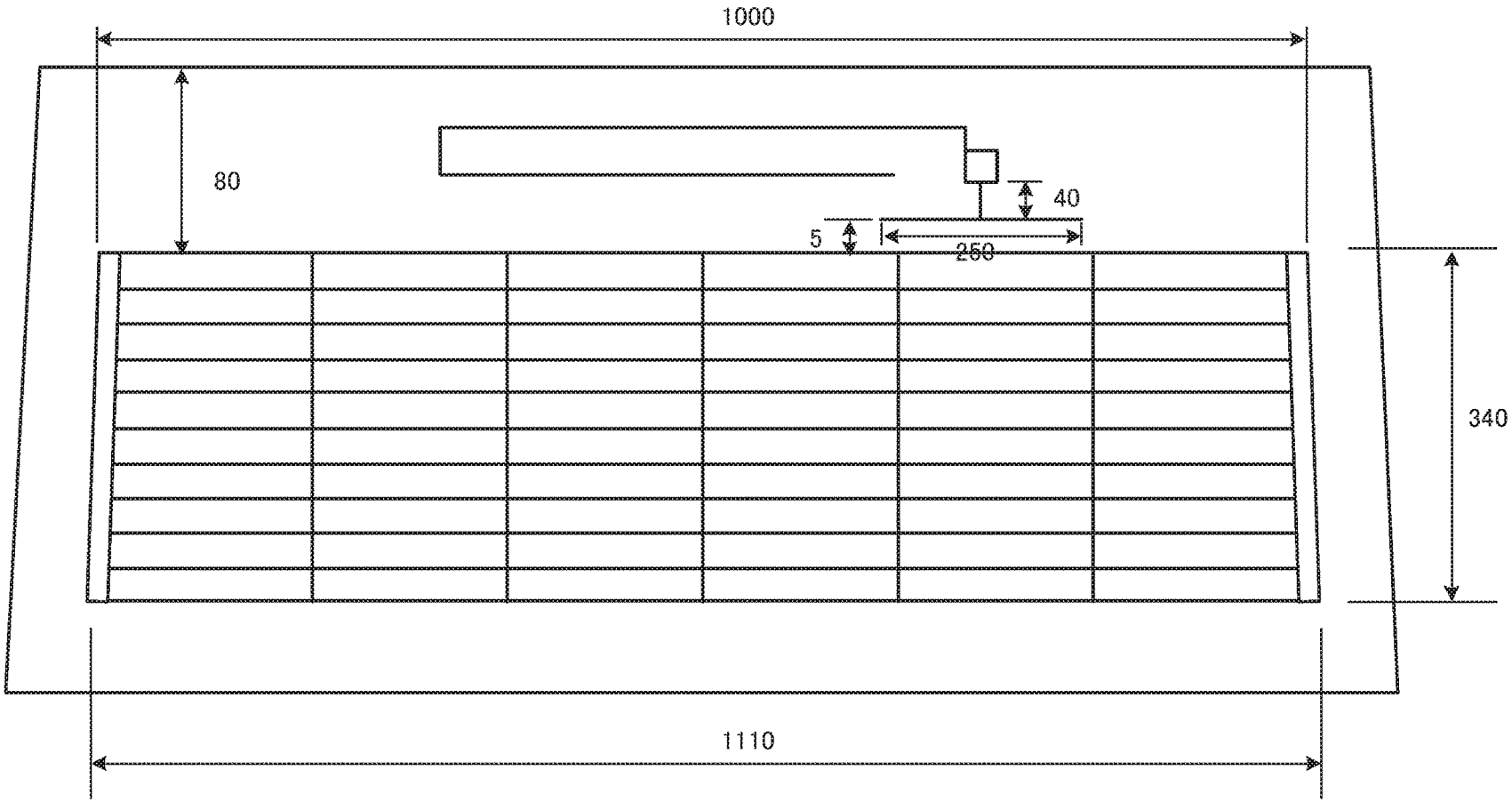
FIG. 20 is a front view of a rear glass on which is disposed a shared antenna according to working example 9.
Figure 21:
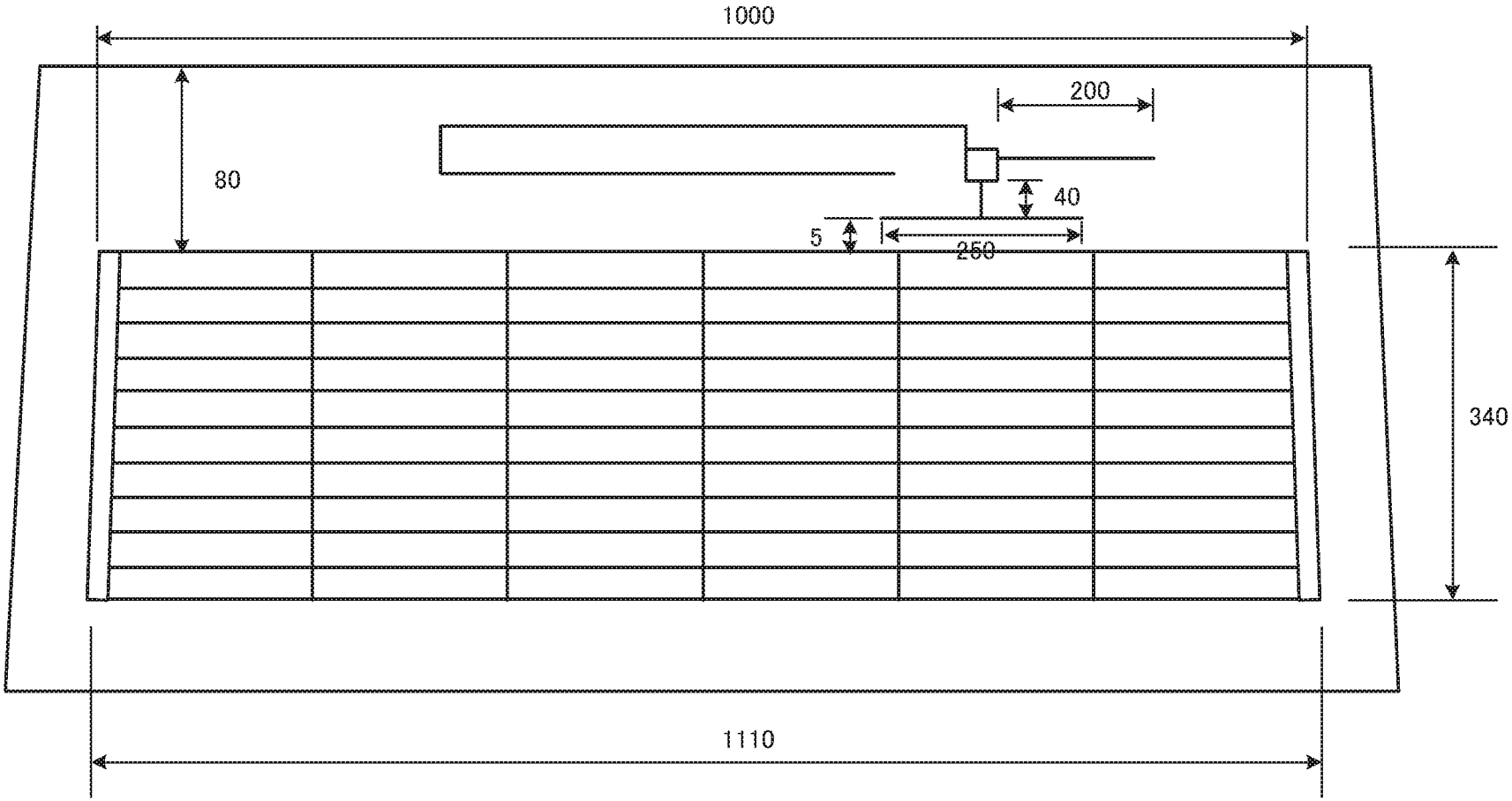
FIG. 21 is a front view of a rear glass on which is disposed a shared antenna according to working example 10.
Figure 22:
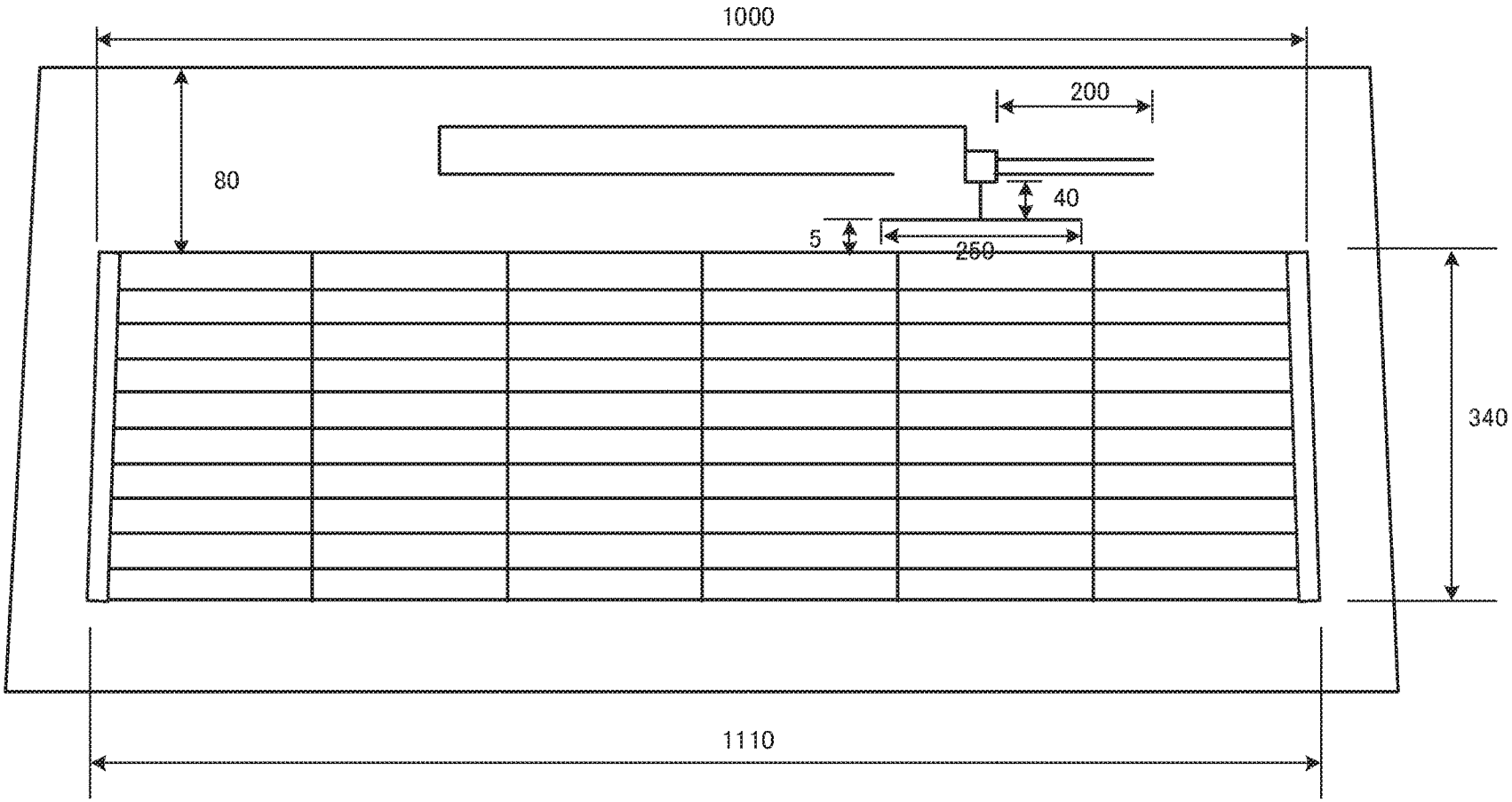
FIG. 22 is a front view of a rear glass on which is disposed a shared antenna according to working example 11.
Figure 23:
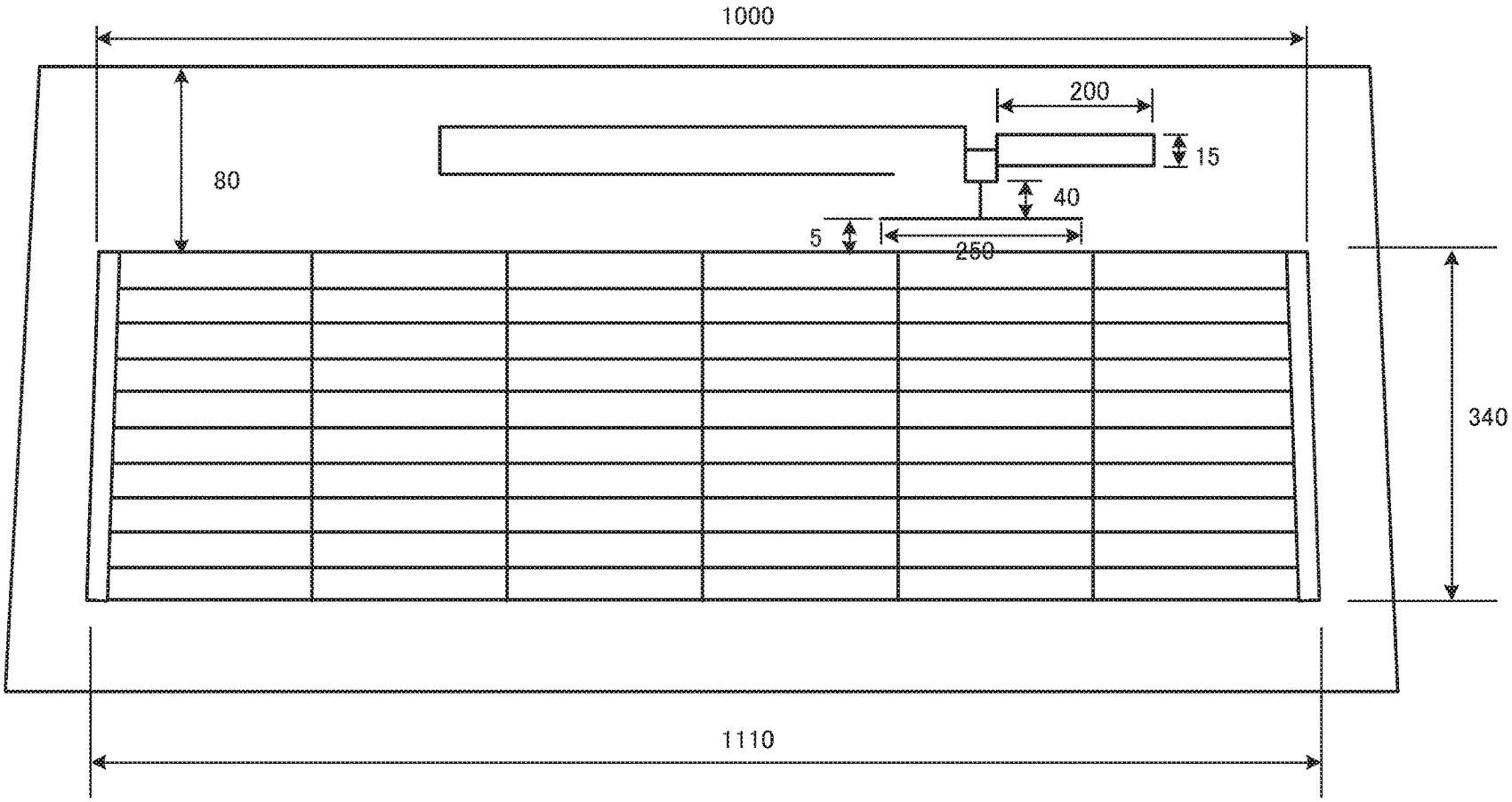
FIG. 23 is a front view of a rear glass on which is disposed a shared antenna according to working example 12.

Next, working examples 9 to 12 in which the shape of the FM antenna was changed were prepared, and the reception performance was measured similarly to the above examinations. FIGS. 20 to 23 show a rear glass on which the shared antennas according to working examples 9 to 12 are disposed (numerical values of the dimensions in FIGS. 20 to 23 are in units of mm). Working example 9 shown in FIG. 20 is not provided with an FM main body element, and the FM antenna is constituted by only first and second FM antenna elements. Working example 10 shown in FIG. 21 is provided with a single element that extends in the horizontal direction from the power supply unit as the FM main body element. Working example 11 shown in FIG. 22 is provided with two parallel elements that extend in the horizontal direction from the power supply unit as the FM main body element. Working example 12 shown in FIG. 23 is provided with a rectangular frame-shaped FM main body element, similarly to the above working examples.

Figure 24:
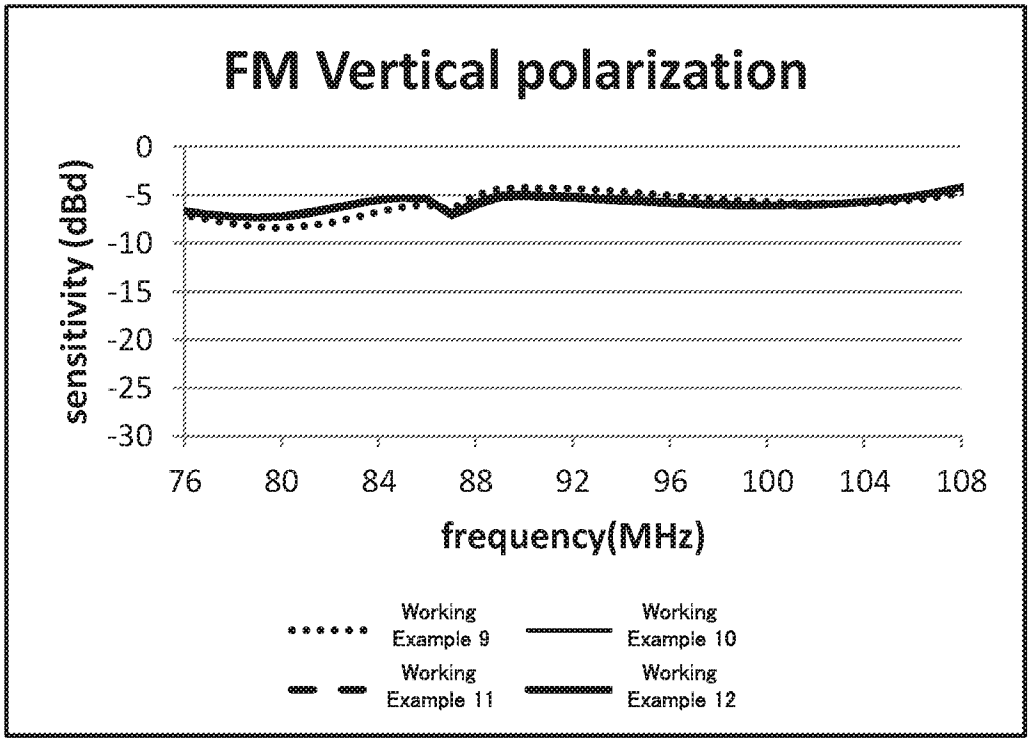
FIG. 24 is a graph showing the reception performance of FM antennas according to working examples 9 to 12.

The results are as shown in FIG. 24. The performance of working example 9, which does not have an FM main body element, is considered to be sufficient to withstand practical use, despite the reception performance having decreased slightly, compared with working examples 10 to 12. Working examples 10 to 12, which have an FM main body element, exhibit generally similar reception performance, irrespective of shape.

REFERENCE SIGNS LIST

3 Rear glass
5 Defogger
6 Shared antenna
61 Power supply unit
62 AM antenna
63 FM antenna

The invention claimed is:

1. A rear glass for attachment to a lift-up backdoor that closes an opening in a rear portion of a vehicle, the rear glass comprising:

a glass plate;

a defogger disposed in a vicinity of a center of the glass plate in an up-down direction; and a shared antenna installed on the glass plate upward or downward of the defogger, wherein the shared antenna includes:

a power supply unit;

an AM antenna connected to the power supply unit; and an FM antenna connected to the power supply unit, wherein the FM antenna includes:

a rectangular frame-shaped FM main body element that is coupled to the power supply, a first FM antenna element extending toward the defogger from the power supply unit; and a second FM antenna element coupled to an end portion of the first FM antenna element and extending in the horizontal direction, wherein the second FM antenna element is positioned closer to the defogger than is the AM antenna, and is capacitively coupled to the defogger, and wherein the first FM antenna element and the FM main body element are respectively directly connected to the power supply unit, and the FM main body element is not directly connected to the first and second FM antenna elements, wherein the length of the defogger in the up-down direction is 65 to 85% of the length of the rear glass in the up-down direction, and a relationship between an element length $L_{AM}$ of the AM antenna, a center wavelength $\lambda_{FM\text{-}C}$ corresponding to a reception frequency band of the FM antenna and a wavelength shortening coefficient $\alpha$ of the glass plate satisfies $0.49\times\alpha\times\lambda_{FM\text{-}C}\leq L_{AM}\leq 0.67\times\alpha\times\lambda_{FM\text{-}C}$.

2. The rear glass according to claim 1, wherein the AM antenna includes:

a first AM antenna element extending in a horizontal direction from the power supply unit;

a second AM antenna element extending in the up-down direction from an end portion of the first AM antenna element; and a third AM antenna element extending in the horizontal direction on the power supply unit side from an end portion of the second AM antenna element.

3. The rear glass according to claim 2, wherein the AM antenna includes:

a fourth AM antenna element extending in the up-down direction on the first AM element side from an end portion of the third antenna AM element; and a fifth AM antenna element extending in the horizontal direction from an end portion of the fourth AM antenna element so as to couple with the second AM antenna element.

4. The rear glass according to claim 1, wherein the defogger includes:

a pair of bus bars respectively extending in the up-down direction along right and left end portions of the glass plate; and a plurality of heating wires extending horizontally so as to join the pair of bus bars.

5. The rear glass according to claim 1, wherein a distance in the up-down direction of a space between the defogger and an upper edge or a lower edge of an inner periphery of the backdoor to which the rear glass is attached is less than or equal to 100 mm, the shared antenna is disposed in the space, and the length of the AM antenna in the up-down direction is less than or equal to 75 mm.

6. The rear glass according to claim 1, wherein the shared antenna is disposed upward of the defogger.

7. The rear glass according to claim 1, further comprising a DAB antenna.

8. A door module of a vehicle comprising:

the rear glass according to claim 1; and at least one door panel configured to support the rear glass and formed from a resin material.

9. The rear glass according to claim 1, wherein the FM antenna is configured to receive FM radio signals only.

10. The rear glass according to claim 1, wherein a length in the up-down direction of a gap between the second FM antenna element and an uppermost portion of the defogger is smaller than a length in the up-down direction of a gap between a lowermost portion of the AM antenna and the upmost portion of the defogger.

11. The rear glass according to claim 9, wherein the second FM antenna element includes a first portion overlapping with the AM antenna in the up-down direction, and a second portion overlapping with the FM main body element in the up-down direction.

12. The rear glass according to claim 9, wherein the power supply unit is disposed between the AM antenna and the FM main body element in the horizontal direction, and the first and second FM antenna elements extend from the power supply unit downwardly and are closer to an uppermost portion of the defogger than the lowermost portion of the AM antenna.

* * * * *